US008695121B2

(12) United States Patent
Nolan et al.

(10) Patent No.: US 8,695,121 B2
(45) Date of Patent: Apr. 15, 2014

(54) ACTIVELY VENTILATED HELMET SYSTEMS AND METHODS

(75) Inventors: William H. Nolan, Lakewood, CO (US); Stephen B. Katsaros, Denver, CO (US)

(73) Assignee: Habervision LLC, Golden, CO (US)

( * ) Notice: Subject to any disclaimer, the term of this patent is extended or adjusted under 35 U.S.C. 154(b) by 1159 days.

(21) Appl. No.: 12/579,906

(22) Filed: Oct. 15, 2009

(65) Prior Publication Data

US 2010/0095439 A1 Apr. 22, 2010

Related U.S. Application Data

(60) Provisional application No. 61/106,135, filed on Oct. 16, 2008.

(51) Int. Cl.
*A42C 5/04* (2006.01)

(52) U.S. Cl.
USPC ..... 2/171.3; 2/424; 2/410

(58) Field of Classification Search
USPC ..... 2/410, 5, 7, 8.6, 422, 424, 425, 435, 2/436, 437, 171.3, 906, DIG. 1
See application file for complete search history.

(56) References Cited

U.S. PATENT DOCUMENTS

| | | | | |
|---|---|---|---|---|
| 3,955,570 | A * | 5/1976 | Hutter, III | 128/201.23 |
| 4,443,893 | A * | 4/1984 | Yamamoto | 2/436 |
| 4,549,542 | A * | 10/1985 | Chien | 128/201.24 |
| 4,704,746 | A * | 11/1987 | Nava | 2/424 |
| 4,996,981 | A * | 3/1991 | Elenewski et al. | 128/201.15 |
| 5,123,114 | A * | 6/1992 | Desanti | 2/8.6 |
| 5,193,347 | A | 3/1993 | Apisdorf | |
| 5,200,736 | A * | 4/1993 | Coombs et al. | 340/586 |
| 5,283,914 | A | 2/1994 | James | |
| 5,452,480 | A * | 9/1995 | Ryden | 2/436 |
| 5,533,500 | A | 7/1996 | Her-Mou | |
| 6,081,929 | A | 7/2000 | Rothrock et al. | |
| 6,122,773 | A | 9/2000 | Katz | |
| 6,470,696 | B1 | 10/2002 | Palfy et al. | |
| 6,792,951 | B2 * | 9/2004 | Evonitz, III | 128/857 |
| 6,896,366 | B2 * | 5/2005 | Rice et al. | 351/62 |
| 6,995,665 | B2 * | 2/2006 | Appelt et al. | 340/521 |
| 7,086,096 | B1 * | 8/2006 | Montero | 2/424 |
| 7,296,304 | B2 * | 11/2007 | Goldsborough | 2/171.3 |
| 7,694,353 | B2 * | 4/2010 | Weston | 2/171.3 |

(Continued)

FOREIGN PATENT DOCUMENTS

| | | | |
|---|---|---|---|
| EP | 268549 | B1 | 10/1990 |
| JP | 2001-055617 | A | 2/2001 |
| JP | 2001-303353 | A | 10/2001 |
| JP | 2005-179795 | A | 7/2005 |

OTHER PUBLICATIONS

PCT International Search Report and Written Opinion mailed May 4, 2010; International Application No. PCT/US2009/060904, 10 pages.

*Primary Examiner* — Danny Worrell
(74) *Attorney, Agent, or Firm* — Kilpatrick Townsend & Stockton LLP

(57) ABSTRACT

Helmet systems and methods reduce the formation of vapor condensation within the helmet interior, and inhibit fogging of the helmet visor. Exemplary embodiments include a helmet shell having a venting tube, a visor coupled with the helmet shell, a humidity sensor that senses humidity within the helmet interior cavity, and a ventilation system that removes moist air from the helmet interior.

22 Claims, 7 Drawing Sheets

(56) References Cited

U.S. PATENT DOCUMENTS

| | | | | |
|---|---|---|---|---|
| 7,802,318 | B2 * | 9/2010 | Chen | 2/171.3 |
| 2002/0104153 | A1 * | 8/2002 | Benedict et al. | 2/424 |
| 2005/0066416 | A1 * | 3/2005 | Ma | 2/171.3 |
| 2005/0278834 | A1 * | 12/2005 | Lee | 2/424 |
| 2006/0048286 | A1 | 3/2006 | Donato | |
| 2006/0053529 | A1 * | 3/2006 | Feher | 2/171.3 |
| 2007/0061946 | A1 * | 3/2007 | Webb | 2/410 |
| 2007/0113324 | A1 * | 5/2007 | Chen | 2/424 |
| 2008/0023002 | A1 * | 1/2008 | Guelzow et al. | 128/201.24 |
| 2009/0276940 | A1 * | 11/2009 | Sallee | 2/435 |
| 2010/0024099 | A1 | 2/2010 | Nolan et al. | |

* cited by examiner

ACTIVELY VENTILATED HELMET SYSTEMS AND METHODS

This application is a nonprovisional of, and claims the benefit of priority to, U.S. Provisional Patent Application No. 61/106,135, filed on Oct. 16, 2008, entitled "Actively Ventilated Helmet," the entire content of which is incorporated herein by reference for all purposes. This application is also related to U.S. patent application Ser. No. 12/534,597, filed on Aug. 3, 2009, which claims the benefit of priority to U.S. Provisional Patent Application No. 61/085,784, filed on Aug. 1, 2008, both entitled "Ventilation System for Goggles." Each of these filings are incorporated herein by reference in their entirety for all purposes.

BACKGROUND OF THE INVENTION

Embodiments of the present invention relate generally to personal safety devices, and in particular to protective helmets for use in sports and other physical or dangerous activities.

Helmet usage has grown to almost 70% compliance amongst skiers and almost 100% with snowboarders. Relatedly, motorcyclists, automobile drivers, skydivers, and the like typically may benefit from wearing a helmet while engaging in their respective activities. However, due to individual factors such as heat generation, respiration, and perspiration, helmet factors such as insulation and ventilation, and environmental factors such as extreme or fluctuating temperature and humidity, helmet users are often disturbed by the unwanted effect of fogging or condensation on the surface of helmet visors or on the surface of eyeglasses worn by the user inside of the helmet, particularly in the instance of full coverage helmets.

Many surfaces can accumulate water vapor when the temperature of the surface is lower than the dew point temperature of the adjacent air. In a ski or motor sports helmet environment, lens temperature and dew point are both subject to frequent change which may result in lens fogging. Two sources of water vapor increase the interior helmet void dew point temperature (the "Dew Point") above that generally prevailing in the user's absence: the user's face, including the eyes, tears therefrom, the skin, and the exhaled breath. Ventilation of the helmet's interior void by rapid user motion can cause the lens temperature to fall. Exhaled breath readily enters the interior void within many helmets due to the air pervious nature of the helmet shell. When the user is in motion, the air stream around the user's head tends to force exhaled breath into the helmet visor and results in intermittent lens fogging. Additionally, in very cold weather the user is likely to wear protective garments about the nose and mouth or around the neck, which can channel the user's exhaled breath into the helmet visor Such condensation can negatively impact the optical performance of the helmet visor, thus obstructing or clouding the vision of the helmet user. A fogged helmet visor can present a highly hazardous situation for the helmet user, and in some cases can lead to serious injury or even death.

Various techniques have been suggested for preventing fogging. For example, helmet manufacturers have developed certain venting systems so as to remove humid air from the helmet interior when the user is traveling at high speed, however the effectiveness of such approaches can be limited, particularly when the helmet user is stationary or moving slowly. Some protective eyewear manufacturers have developed thermal or double lens designs in an attempt to reduce fogging, however such approaches can unduly compromise the optical performance of the eyeshield.

Hence, although solutions have been proposed to address the issue of fogging, there remains a need for improved systems and methods that reliably reduce or inhibit the formation of visor condensation. Embodiments of the present invention address this important need.

BRIEF SUMMARY OF THE INVENTION

Embodiments of the present invention incorporate unique fan technology that overcomes certain limitations of previous systems, so as to effectively prevent or remove condensation from a helmet visor surface.

Helmet system embodiments of the present invention can provide full impact protection, 180 degrees of panoramic vision, a fog free environment, protection from frostbite, protection from UV exposure, and excellent fit for eyeglass wearers, all in one integrated design. Helmet embodiments are well suited for use in any of a variety of athletic pursuits, including without limitation skiing, snowboarding, mountaineering, skydiving, and the like. Further, helmet embodiments are well suited for use by persons engaging in motor sports, police or military activities, industrial or construction work projects, and the like.

Embodiments of the present invention incorporate a fan and a humidity sensor into an integrated helmet configuration that provides a fog free environment within the interior of the helmet. Helmet embodiments are comfortable to wear, perform as intended, and are not apt to create a claustrophobic feeling in the helmet user. Helmet embodiments are configured to pass any and all impact tests established by regulatory bodies in any country where helmet products can be sold or used. Relatedly, helmet embodiments can comply with any and all optical requirements set by regulatory bodies in any country where helmet products can be sold or used.

Embodiments of the present invention encompass both full coverage and open face helmet system configurations. In some cases, helmet configurations may be convertible between full coverage and open face configurations. Helmet systems can be configured to protect the user from impacts typically experienced in skiing or snowboarding, and other potentially hazardous activities. Helmet systems can be sized so as to not generally or significantly exceed the size or weight of helmets currently available on the market. In some cases, helmet systems can incorporate an optically efficient lens that attaches to the helmet and appendages only and in no way touches a user's face. An optical shield can be removable, for example, by rotating upwards or by complete removal, and in some cases both. Helmet systems can be configured to provide a fog free environment at all times. In some cases, helmet systems may include an outer shell that includes polycarbonate or other materials, and in some cases the material composition of the helmet shell or other helmet system components can be selected based on safety considerations, cost considerations, or both. In some cases, a helmet system may include an absorptive layer that includes expanded polystyrene (EPS).

In one aspect, embodiments of the present invention encompass a helmet system or method for removing or reducing condensation from a user's field of vision. A helmet system may include, for example, a helmet shell having an anterior section, a posterior section, and a venting passage. The helmet shell can define an internal cavity that is in fluid communication with a front portion of the venting passage, and the internal cavity can be configured to receive the user's head. The helmet system may also include a visor coupled with the anterior section of the helmet shell, a humidity sensor positioned within the internal cavity of the helmet shell, and a ventilation system. In some cases, the ventilation system includes a base, a base cover, an air movement assembly, a power source, and a processor. Optionally, the power source, or the processor, or both, may be located elsewhere in the helmet system. In some cases, the helmet system may not include a power source. In some cases, the helmet may be operationally coupleable with a power source.

The base of the ventilation system may be coupled with the posterior section of the helmet shell, and the base can have a venting intake aperture in fluid communication with a rear portion of the venting passage. The base cover can be coupled with the base, and the base cover can include a venting outflow aperture. The air movement assembly can be disposed between the base and the base cover, and the air movement assembly can provide fluid communication between the venting intake aperture and the venting outflow aperture. The power source can provide power to the air movement assembly or other components of the helmet system. The processor can have an input configured to receive a signal from the humidity sensor, a module configured to determine an instruction for the air movement assembly based on the signal received from the humidity sensor, and an output configured to transmit the instruction to the air movement assembly. Activation of the air movement assembly based on the instruction can operate to remove condensation from the user's field of vision by withdrawing a volume of air from the internal cavity of the helmet shell through the venting passage and expelling the volume of air out of the venting outflow aperture of the base cover.

In some embodiments, the air movement assembly comprises one or more rotary fans. Optionally, the helmet system may include an exterior space sensor, and the processor module can have an input configured to receive a signal from the exterior space sensor. Further, the processor module can be configured to determine the instruction for the air movement assembly based on the signal received from the exterior space sensor. In some cases, the exterior space sensor may include a temperature sensor. The helmet system may also include a supplemental sensor. The processor module may include an input configured to receive a signal from the supplemental sensor, and the processor module can be configured to determine the instruction for the air movement assembly based on the signal received from the supplemental sensor. In some cases, the supplemental sensor includes an accelerometer, a global positioning satellite sensor, a heart rate sensor, a temperature sensor, or a humidity sensor, or any combination thereof. In some cases, the helmet shell includes a chin bar having a vent.

In another aspect, embodiments of the present invention encompass a helmet system or method for removing condensation from a user's field of vision, in which a helmet system may include a passive intake aperture located at an anterior section of the helmet shell, a passive outflow aperture located at a posterior section of the helmet shell, a first venting passage assembly that provides fluid communication between the passive intake aperture and the passive outflow aperture, and a second venting passage. The helmet shell can define an internal cavity that is configured to receive the user's head and that is in fluid communication with a front portion of the first venting passage assembly and with a front portion of the second venting passage. The helmet system may also include a visor coupled with the anterior section of the helmet shell, a humidity sensor positioned within the internal cavity of the helmet shell, and a ventilation system. In some cases, the ventilation system may include a base, a base cover, an air movement assembly, and a processor. The base can be coupled with the posterior section of the helmet shell, and may have a venting intake aperture in fluid communication with a rear portion of the second venting passage. The base cover can be coupled with the base, and can have a venting outflow aperture. The air movement assembly can be disposed between the base and the base cover, and can provide fluid communication between the venting intake aperture and the venting outflow aperture. The processor can have an input configured to receive a signal from the humidity sensor, a module configured to determine an instruction for the air movement assembly based at least in part on the signal received from the humidity sensor, and an output configured to transmit the instruction to the air movement assembly. Activation of the air movement assembly based on the instruction can operate to remove condensation from the user's field of vision by withdrawing a volume of air from the internal cavity of the helmet shell through the second venting passage and expelling the volume of air out of the venting outflow aperture of the base cover. In some cases, the air movement assembly includes one or more rotary fans. In some cases, the helmet system includes an exterior space sensor, and the processor module can have an input configured to receive a signal from the exterior space sensor. The processor module can be configured to determine the instruction for the air movement assembly based at least in part on the signal received from the exterior space sensor. In some cases, the exterior space sensor includes a temperature sensor. Optionally, the helmet system may include a supplemental sensor, and the processor module can have an input configured to receive a signal from the supplemental sensor. The processor module can be configured to determine the instruction for the air movement assembly based at least in part on the signal received from the supplemental sensor. In some cases, the supplemental sensor includes an accelerometer, a global positioning satellite sensor, a heart rate sensor, a temperature sensor, or a humidity sensor, or any combination thereof. Some helmet system embodiments may include a chin bar having a vent, whereby air may enter into the interior of the helmet cavity via the chin bar vent.

In a further aspect, embodiments of the present invention encompass helmet systems and methods for removing condensation from a user's field of vision, in which a helmet shell can include an anterior section, a posterior section, and a venting passage assembly having a venting passage in fluid communication with a passive intake passage. The helmet shell can define an internal cavity that is in fluid communication with a front portion of the venting passage, and the internal cavity can be configured to receive the user's head. The passive intake passage can be in fluid communication with a passive intake aperture located at the anterior section of the helmet shell. The helmet system may also include a visor coupled with the anterior section of the helmet shell, a humidity sensor positioned within the internal cavity of the helmet shell, and a ventilation system. According to some embodiments, the ventilation system may include a base coupled with the posterior section of the helmet shell, and the base can have a venting intake aperture in fluid communication with a rear portion of the venting passage. A ventilation system may also include a base cover coupled with the base, and the base cover can have a venting outflow aperture. A ventilation system may further include an air movement assembly disposed between the base and the base cover. The air movement assembly can provide fluid communication between the venting intake aperture and the venting outflow aperture. Optionally, the ventilation system may include a power source and a processor. An exemplary processor may include an input configured to receive a signal from the humidity sensor, a module configured to determine an instruction for the air movement assembly based on the signal received from the humidity sensor, and an output configured to transmit the instruction to the air movement assembly. In some cases, activation of the air movement assembly based on the instruction operates to remove condensation from the user's field of vision by withdrawing a volume of air from the internal cavity of the helmet shell through the venting passage and expelling the volume of air out of the venting outflow aperture of the base cover. According to some embodiments, the helmet system may include a valve that controls airflow through the passive intake passage. In some cases, the helmet system may include an exterior space sensor, and the processor module can have an input configured to receive a signal from the exterior space sensor. Additionally, the processor module can be configured to determine the instruction for the air movement assembly based on the signal received from the exterior space sensor. In some cases, a helmet system may include an exterior space sensor that has a temperature sensor. In some cases, a helmet system may include a supplemental sensor, and the processor module can have an input configured to receive a signal from the supplemental sensor. The processor module can be configured to determine the instruction for the air movement assembly based on the signal received from the supplemental sensor. In some embodiments, the supplemental sensor includes an accelerometer, a global positioning satellite sensor, a heart rate sensor, a temperature sensor, or a humidity sensor, or any combination thereof.

For a fuller understanding of the nature and advantages of the present invention, reference should be had to the ensuing detailed description taken in conjunction with the accompanying drawings.

DETAILED DESCRIPTION OF THE INVENTION

Figure 1:
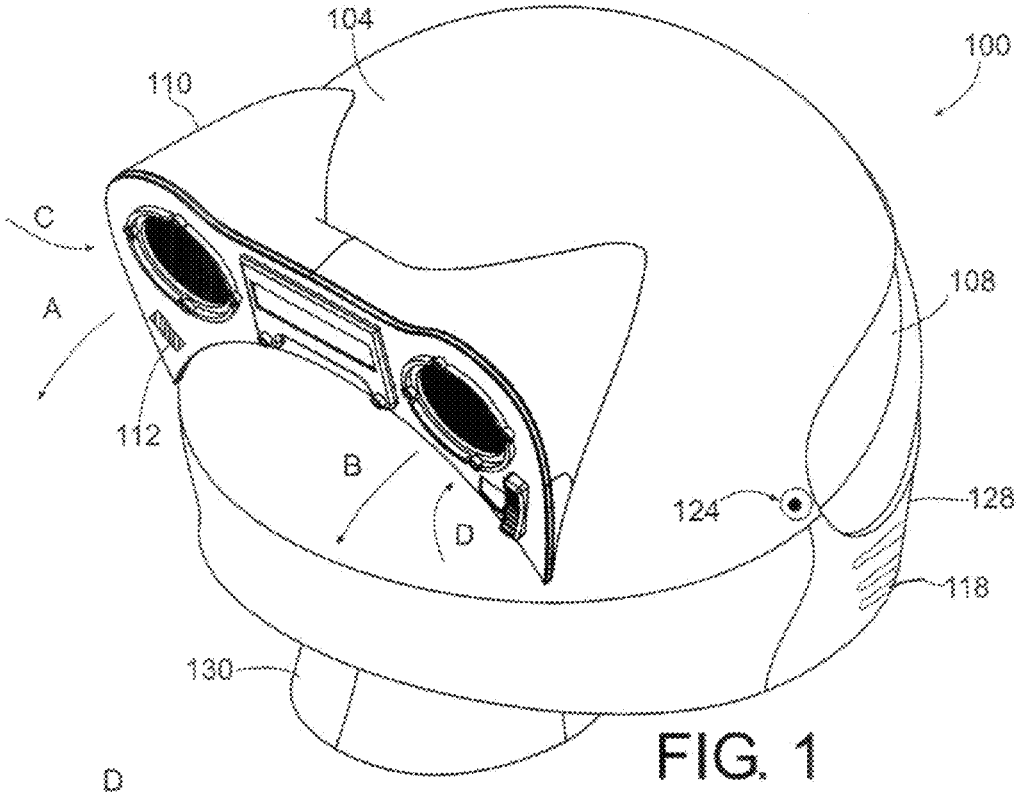
FIG. 1 shows a perspective view of aspects of a helmet system according to embodiments of the present invention.

The ensuing description provides exemplary embodiment(s) only, and is not intended to limit the scope, applicability or configuration of the disclosure. Rather, the ensuing description of the exemplary embodiment(s) will provide those skilled in the art with an enabling description for implementing exemplary embodiments. It being understood that various changes may be made in the function and arrangement of elements without departing from the spirit and scope as set forth in the claims.

Embodiments of the present invention encompass helmet systems and methods that provide enhanced viewing capabilities, particularly for users engaged in sports and other physical activities. In some cases, helmet systems may include a humidity sensor activated fan that when activated, vents fog producing humidity from the helmet interior out to the atmosphere. Such helmet systems can also provide impact protection on par with other helmet products currently available. In some cases, helmet systems may include padding or other fit elements inside the helmet that are removable, washable, and non-irritating. Exemplary helmet systems can provide the user with a visual field of 180 degrees from side to side. A helmet system lens or shield can be optically correct with no aberrations, waves, distortions, or other defects. In some cases, helmet system visors or shields may include cylindrical, toroidal, or spherical lens configurations, or other corrective lens shapes or designs. Optionally, helmet system lens shields may provide 100% attenuation of UV radiation to 400 nm. According to some embodiments, helmet systems may include visors or lenses having fixed density, polarized, or photochromatic properties, or combinations thereof. In some cases, a lens may have a thickness within a range from about 1.8 mm to about 3 mm. Helmet systems may include lenses or shields that rotate up and down, that are removable, and that are interchangeable. A helmet system may also include a removable chin bar. In some cases, a helmet system may include a fan component or air movement assembly that can be set to three or more operating modes, including OFF, ON, and AUTO. A helmet system can have an air movement assembly configured to provide a run time of 12 hours, or more. A helmet system can also be configured to withstand vibrations typically experienced by those skiing or snowboarding.

According to some embodiments, helmet systems may include an air movement assembly or fan unit that is capable of moving a volume of air to achieve the desired effect (non-fogging) in an efficient manner. For example, the air movement assembly can have the ability to vent warm moist air while not leaching moisture from the eye that is noticeable or detrimental to the wearer. In some cases, a helmet, shield, fan, and other interconnected components can withstand a drop from 6 feet, or more, without effecting performance. Air movement assembly or fan unit components can be configured to resist damage by falls common in skiing and snowboarding that do not induce injury to the head such as concussions or unconsciousness. Helmet systems can be configured for use in winter environments, summer environments, spring environments, fall environments, or any combination thereof. Helmet systems can provide effective fog or condensation control properties that are not diminished by extremes of heat or cold. According to some embodiments, any component installed in a helmet system, such as a switch, circuit board, fan motor, battery, or the like, can be water resistant or otherwise well suited for use in snow, wind, rain, and sleet. Helmet systems can be configured to effectively perform fog or condensation control under ambient temperature conditions ranging from about 120 degrees F., or higher, to about negative 60 degrees F., or lower.

Referring initially to FIG. 1, a rear perspective view of an embodiment of an actively ventilated helmet system 100 is shown. An outer shell 104 of helmet system 100 includes a lens, visor, or shield 108. Optionally, helmet system 100 includes one or more hinges 124 coupled with visor 108 and outer shell 104, which allow movement of visor or eyeshield 108 relative to shell 104, for example to expose or cover the face of a person 130 wearing the helmet system. In some embodiments, visor 108 may rotate up and down along the outside of outer shell 104, and in some embodiments, visor 108 may rotate up and down along the inside of outer shell 104.

Helmet system 100 may include a chin bar 128 that extends generally in front of a mouth or chin of the wearer. In some cases, chin bar 128 may include one or more vents 118. In some cases, chin bar 128 may not include a vent. Optionally, outer shell 104 may include one or more vents in addition to, or instead of, a chin bar vent 118. As shown here, helmet system 100 also includes a ventilation module 110 coupled with or integrated into outer shell 104. Ventilation module 110 can operate to facilitate the movement of air from inside of the helmet interior, out toward the external ambient environment, as indicated by arrows A and B. Optionally, ventilation module 110 can operate to facilitate the movement of air from outside of the helmet, in toward the helmet interior, as indicated by arrows C and D. For example, the helmet system may include a selector switch 112 that can be toggled by the user between an Outward and an Inward setting. When the selector switch is in the Outward setting, fan blades of the ventilation module can be configured to direct air as indicated by arrows A and B, so that air flows from the helmet interior to the outside environment. When the selector switch is in the Inward setting, fan blades of the ventilation module can be configured to direct air as indicated by arrows C and D, so that air flows from the outside environment into the helmet interior.

Figure 2:
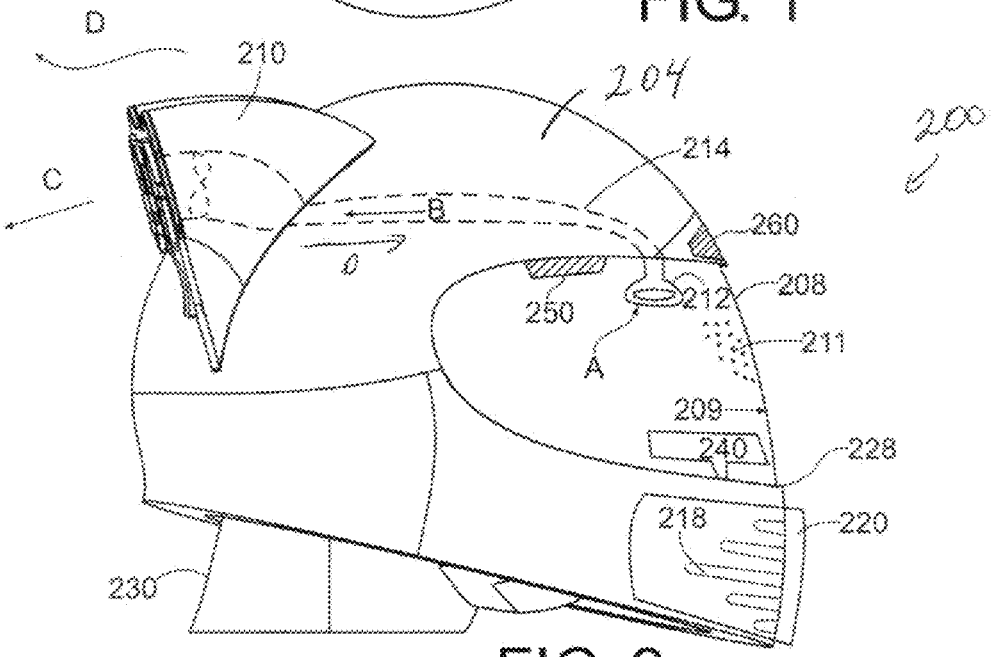
FIG. 2 provides a side view of aspects of a helmet system according to embodiments of the present invention.

FIG. 2 illustrates aspects of a helmet system 200 according to embodiments of the present invention. Helmet system 200 includes an outer shell 204, a ventilation system 210, and a chin bar 228 having a chin bar vent 218. As shown here, helmet system 200 may also include one or more vent covers 220 that can be opened, closed, or otherwise adjusted to regulate air flow that can occur between the external environment and the helmet interior through vent 218. In some cases, a vent cover 220 can be opened, closed, or otherwise adjusted to regulate the temperature within the interior of helmet system 200. Helmet system 200 may include a heads-up display 240 that displays information such as the heart rate or velocity of a person 230 wearing the helmet system, the temperature or humidity of the helmet interior space, the temperature or humidity of the ambient environment external to the helmet, the temperature of a helmet system component such as a visor 208 of the helmet system, activity of a de-fogging circuitry, a terrain map or other geographical illustration, and the like. Optionally, heads-up display 240 can be mounted from chin bar 228. Helmet system 200 may include or operatively facilitate a connectivity modality, such as a Bluetooth link, between one or more sensors, such as a GPS sensor, that obtains information which can be presented at heads-up display 240 or other data presentation elements of helmet system 200. In some cases, such sensors can be used to gather information not available within helmet system 200. In some cases, such sensors can be used to gather information that is available within helmet system 200.

In some cases, helmet systems and methods provide a full coverage ski helmet that includes humidity sensor driven fan technology such as that described in previously incorporated U.S. patent application Ser. No. 12/534,597, filed on Aug. 3, 2009, and U.S. Provisional Patent Application No. 61/085,784, filed on Aug. 1, 2008, both entitled "Ventilation System for Goggles."

Helmet system 200 may include one or more suction vents 212 within the helmet interior that facilitate the removal of air from the helmet system interior space. For example, excessively humid air within the helmet can pass through suction vent 212 as indicated by arrow A, through a tube or passage 214 as indicated by arrow B, and out of ventilation system 210 as indicated by arrow C. Passage 214 can include a plastic tube, or a molded passage or tube, such as a passage or tube formed by a molded channel in a styrene liner of the helmet or shell, for example. In some cases, such air removal from the helmet interior may be accompanied by air intake, or air flow from the outside of the helmet through vent 218 into the helmet interior. Hence, helmet system 200 can provide fluid communication between vent 212, passage 214, and ventilation system 210. In some cases, this air removal assembly of helmet system 200 can operate to ward off or reduce fogging of visor 208. Optionally, helmet system 200 may include one or more interior space sensors 250 that sense humidity, dew point, temperature, pressure, or moisture parameters, or any combination thereof, that may exist within the interior space of the helmet. Helmet system 200 can use information provided by interior space sensor 250 to determine if or when there may be a risk of fogging on visor 208. Helmet system 200 may also include one or more exterior space sensors 260 that sense humidity, dew point, temperature, pressure, or moisture parameters, or any combination thereof, that may exist within or outside of the interior space of the helmet. Helmet system 200 can also use information provided by exterior space sensor 260 to determine if or when there may be a risk of fogging on visor 208. In some cases, an exterior space sensor 260 may be embedded in visor 208 for determining temperature parameters associated with the visor. According to some embodiments, helmet system 200 can be configured to activate ventilation system 210 when there is a risk or presence of fogging of the visor. Temperature sensors inside and outside the helmet can be used to help determine when fogging might occur in some embodiments. According to some embodiments, helmet system 200 can be configured to activate ventilation system 210 when there is a risk or presence of extreme or uncomfortable temperatures within the helmet, for example if the helmet system interior is uncomfortably hot as determined by the person wearing the helmet system, regardless of any risk or presence of fogging.

During use, the helmet wearer 230 will typically be participating in an outdoor activity (e.g. snow skiing or motor sports). While traveling at a relatively high speed, the user may enjoy unobstructed vision because vapor has not condensed on the lens back or interior surface 209. This unobstructed vision may be due to air flowing through vent 218, or through some other passive ventilation system of the helmet, such as the passive ventilation configuration discussed with regard to FIG. 2A below. However, passive ventilation alone, regardless of user speed, may not be sufficient to remove or prevent condensation on the helmet visor. Moreover, when the user stops, the propensity for fogging increases because air is not being forced through the openings in the helmet. As the user perspires, tears are generated by the eyes and humid air is exhaled. Hence, the humidity level inside the helmet can increase to a level where the dew point temperature exceeds the temperature of the lens back surface 209 and vapor begins to buildup thereon. When the user has the ventilation system 210 in an 'auto' condition via a switch interface, the ventilation system 210 responds to this increase in humidity by powering an air movement or fan assembly of the ventilation system 210. In some embodiments, the helmet system may have a processor configured to activate the ventilation system when certain fog-inducing conditions are present or detected.

For example, the processor may be configured to automatically activate the ventilation system when the processor receives signals from an accelerometer or GPS device that the user is stationary or moving at a low rate of speed. Similarly, the processor may be configured to automatically activate the ventilation system when the processor receives signals from a heart rate sensor or a temperature sensor indicating that the user is in a state of physical exertion or is otherwise breathing or perspiring at a rate likely to lead to fogging of the face shield or visor.

For example, excessive vapor or condensation 211 can be sensed by a humidity sensor 250 which causes the ventilation system 210 to be activated. The vapor 211 is pulled from the interior portion of the helmet into the vent 212, through the tube or passage 214, and is ultimately ejected from the ventilation system. As a result of removing and ejecting the vapor 211, the amount of relative humidity in the interior portion of the helmet is reduced. This reduction of vapor 211 continues until the humidity level, as determined by the humidity sensor, has decreased enough to cause a temporary suspension in the operation of the ventilation system 210.

In some cases, helmet system 200 can provide passive venting as follows. When the helmet user is traveling at speed, air flows across the top of the helmet, or otherwise from the front of the helmet toward the rear as indicated by arrow D, so as to form a low pressure region behind the ventilation system 210. This low pressure region effectively operates to draw air from inside of the helmet, through vent 212, tube 214, and out of ventilation system, as indicated by arrows A, B, and C, respectively.

According to some embodiments, helmet system 200 can be configured to provide direct cooling or air flow to the head of the user. For example, based on information or data received from interior space sensor 250, exterior space sensor 260, or both, a processor may generate an instruction for activation of ventilation system 210, so that the ventilation system directs air through tube 214, in the direction indicated by arrow D, and such air then exits vent 212, or another passage or port directed toward the user's head.

Figure 2A:
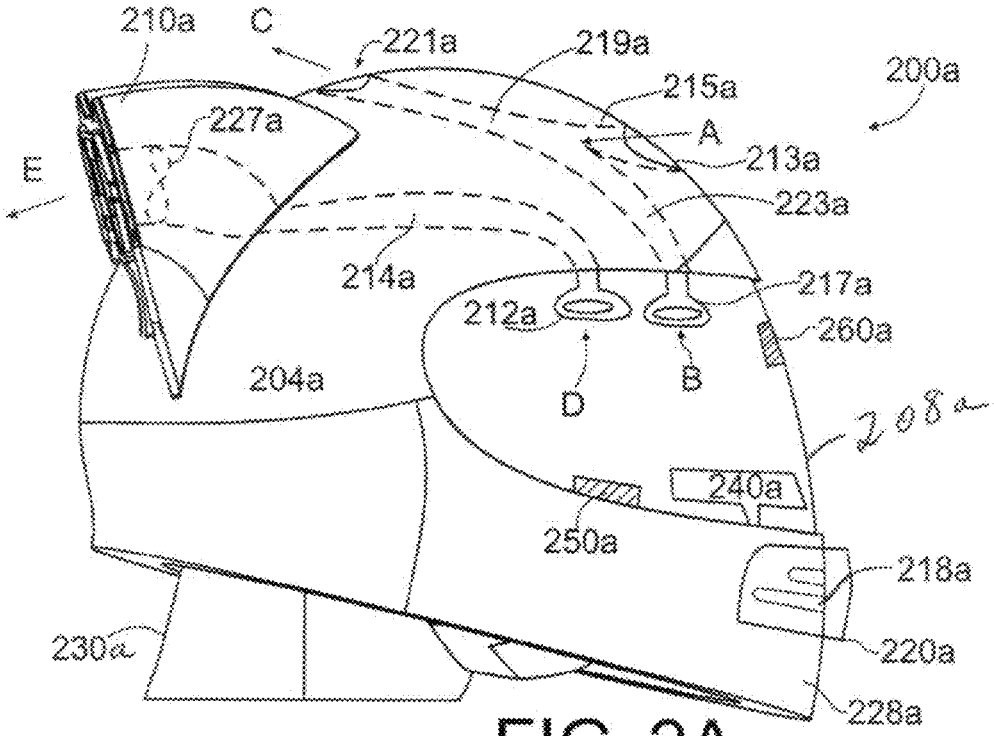
FIG. 2A depicts a side view of aspects of a helmet system according to embodiments of the present invention.

FIG. 2A illustrates aspects of a helmet system 200*a* according to embodiments of the present invention. Helmet system 200*a* includes an outer shell 204*a*, a ventilation system 210*a*, and a chin bar 228*a* having a chin bar vent 218*a*. As shown here, helmet system 200*a* may also include one or more vent covers 220*a* that can be opened, closed, or otherwise adjusted to regulate air flow that can occur between the external environment and the helmet interior through vent 218*a*. In some cases, a vent cover 220*a* can be opened, closed, or otherwise adjusted to regulate the temperature within the interior of helmet system 200*a*. Helmet system 200*a* may include a heads-up display 240*a* that displays information such as the heart rate or velocity of a person 230*a* wearing the helmet system, the temperature or humidity of the helmet interior space, the temperature of humidity of the ambient environment external to the helmet, the temperature of a helmet system component such as a visor 208*a* of the helmet system, activity of a de-fogging circuitry, a terrain map or other geographical illustration, and the like. Optionally, heads-up display 240*a* can be mounted from chin bar 228*a*. Helmet system 200*a* may include or operatively facilitate a connectivity modality, such as a Bluetooth link, between one or more sensors, such as a GPS sensor, that obtains information which can be presented at heads-up display 240*a* or other data presentation elements of helmet system 200*a*. In some cases, such sensors can be used to gather information not available within helmet system 200*a*. In some cases, such sensors can be used to gather information that is available within helmet system 200*a*.

Helmet system 200*a* may include one or more suction vents 217*a* within the helmet interior that facilitate the removal of air from the helmet system interior space into tube 223*a*. Helmet system 200*a* can also include a passive intake aperture 213*a* that allows air to flow from the external environment into a passive intake passage 215*a*. In turn, passive intake passage 215*a* and interior intake tube 223*a* are in fluid communication with a tube or passage 219*a*. When a helmet user is traveling at speed, air flows from outside of the helmet, into intake aperture 213*a* and through intake passage 215*a*. As the outside air flows from intake passage 215*a* into tube 219*a*, as indicated by arrow A, that incoming outside air acts to draw or entrain air from the helmet interior into suction vents 217*a*, through tube 223*a*, and through tube 219*a*, as indicated by arrow B. The combined outer air and inner air continues to flow through tube 219*a*, and out of the helmet through an exit port 221*a* as indicated by arrow C. Hence, helmet system 200*a* can provide fluid communication or a fluid pathway between aperture 213*a*, passage 215*a*, tube 217*a*, and exit port 221*a*. Likewise, helmet system 200*a* can provide fluid communication or a fluid pathway between vent 217*a*, tube 223*a*, tube 219*a*, and exit port 221*a*. In some situations, this passive air removal assembly of helmet system 200*a* can help to ward off or reduce fogging of visor 208*a*.

In addition to the passive venting configuration described above, helmet system 200*a* may include an active venting configuration that complements the passive configuration. For example, helmet system 200*a* can include one or more suction vents 212*a* within the helmet interior that facilitate the removal of air from the helmet system interior space. Suction vents 212*a* can allow air to travel from the helmet interior into a tube or venting passage 214*a*, as indicated by arrow D. Activation of ventilation system 210*a*, which can involve for example rotating fan blade 227*a*, can operate to draw air from the helmet interior into vents 212*a*, through venting tube 214*a*, through ventilation system 210*a*, and out of the helmet as indicated by arrow E. Hence, helmet system 200*a* can provide fluid communication or a fluid pathway between vent 212*a*, tube 214*a*, and ventilation system 210*a*. In some cases, this air removal assembly of helmet system 200*a* can operate to ward off or reduce fogging of visor 208*a*. Optionally, helmet system 200*a* may include one or more interior space sensors 250*a* that sense humidity, dew point, temperature, pressure, moisture, or other parameters, or any combination thereof, that may exist within the interior space of the helmet. Helmet system 200*a* can use information provided by one or more interior space sensors 250*a* to determine if or when there may be a risk of fogging on visor 208*a*. Helmet system 200*a* may also include one or more exterior space sensors 260*a* that sense humidity, dew point, temperature, pressure, or moisture parameters, or any combination thereof, that may exist within or outside of the interior space of the helmet. Helmet system 200*a* can also use information provided by exterior space sensor 260*a* to determine if or when there may be a risk of fogging on visor 208*a*. In some cases, an exterior space sensor 260*a* may be embedded in visor 208*a* for determining temperature parameters associated with the visor. According to some embodiments, helmet system 200*a* can be configured to activate ventilation system 210*a* when there is a risk or presence of fogging of the visor. Temperature sensors inside and outside the helmet can be used to help determine when fogging might occur in some embodiments. Helmet system 200*a* can include any of a variety of sensors coupled with ventilation system 210*a*. Such sensors, or connectivity wires or elements associated with such sensors, may optionally be routed at least partially within a passage such as a first passage 214*a* or a second passage 219*a*, or both. According to some embodiments, helmet system 200*a* can be configured to activate ventilation system 210*a* when there is a risk or presence of extreme or uncomfortable temperatures within the helmet, for example if the helmet system interior is uncomfortably hot as determined by the person wearing the helmet system, regardless of any risk or presence of fogging.

Figure 2B:
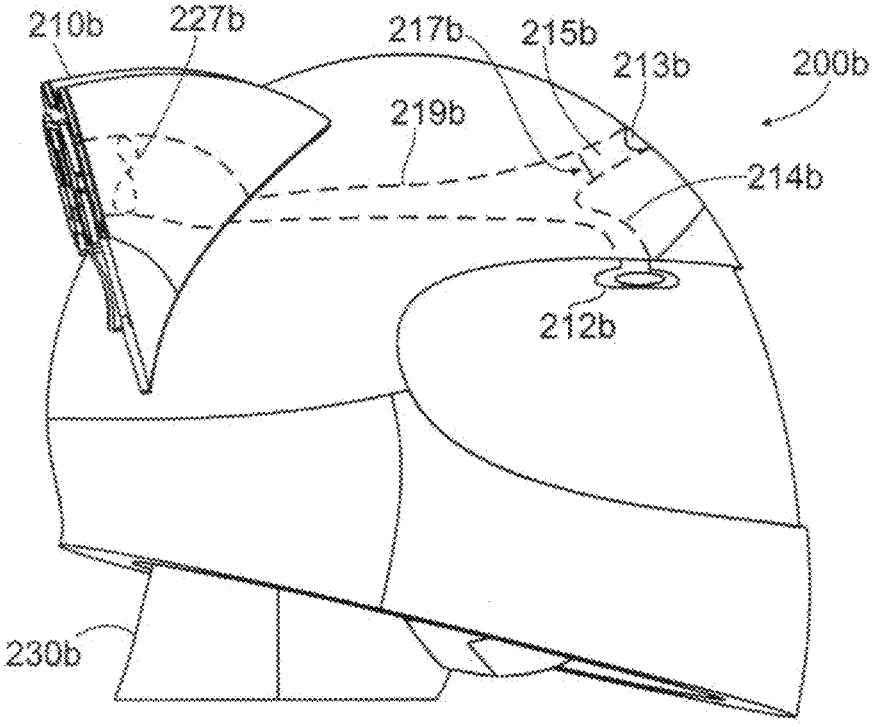
FIG. 2B shows a side view of aspects of a helmet system according to embodiments of the present invention.

FIG. 2B shows another helmet system embodiment that can provide both passive and active venting of the helmet interior. Helmet system 200*b* includes an interior intake vent 212*b* in fluid communication with an interior intake passage 214*b*. Helmet system 200*b* also includes an exterior intake vent 213*b* in fluid communication with an exterior intake passage 215*b*. As shown here, the helmet system also includes a valve or closure 217*b* that can allow or prevent or otherwise regulate flow through exterior intake passage 215*b*. Valve or closure 217*b* may be actuated automatically, for example by control instructions provided by a processor in the helmet system. In some cases, valve or closure 217*b* may be operated manually by the user. In use, when the user 230*b* is traveling at a speed sufficient to effectively passively vent the helmet interior, air from the exterior enters exterior intake vent 213*b*, flows through passage 215*b* past valve 217*b* and into passage 219*b*, where the incoming exterior air combines with, entrains, or otherwise draws air from the helmet interior that passes through intake vent 212*b* and into intake passage 214*b*. The combined exterior and interior air can then pass through tube 219*b* and out of the helmet system through ventilation system 210*b*, even if the ventilation system is not activated or fan blade 227*b* is not being powered by a power source. In such instances, fan blade 227*b* may simply rotate passively due to the flow of the combined air as it travels past the fan. When a processor of the helmet system determines that conditions within the helmet interior may benefit from active venting, the helmet system may initiate rotation of the fan blade. In turn, ventilation system 210*b* can draw from tube 219*b*. In an automatic valve or closure embodiment, in such instances, helmet system 200*b* may also operate to close valve 217*b*, so that interior helmet air enters tube 219*b*, but exterior air does not.

Figure 3:
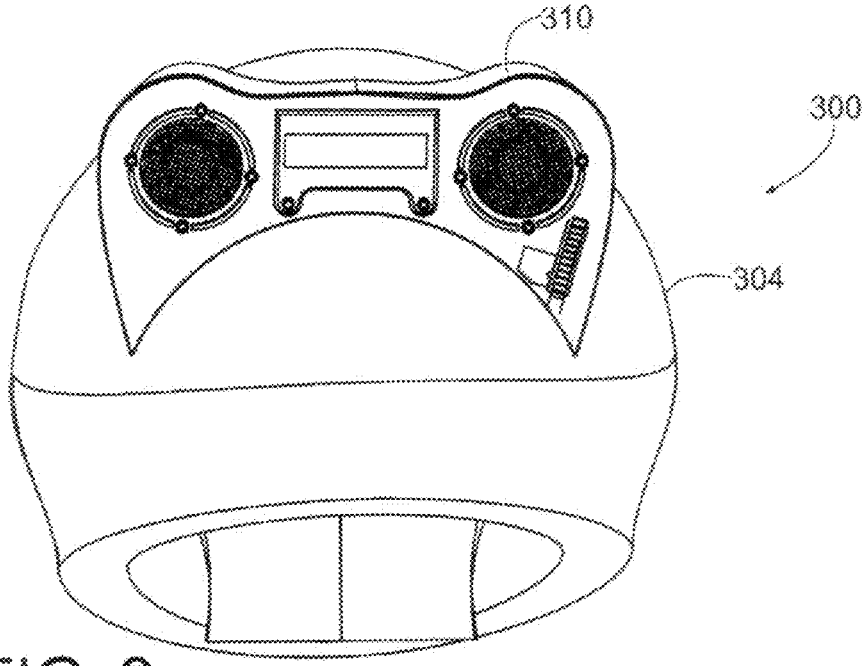
FIG. 3 illustrates a rear view of aspects of a helmet system according to embodiments of the present invention.

With reference to FIG. 3, a back view of an embodiment of an actively ventilated helmet system 300 is shown. According to this embodiment, helmet system 300 may include a ventilation system or module 310 coupled with an outer shell 304 of the helmet system. For example, ventilation system 310 can be coupled with or integrated into a rear surface of the outer shell. Optionally, the ventilation system 310 can be mounted on a different component of the helmet system. For example, the ventilation system can be coupled with a helmet system chin bar. In some cases, ventilation system 310 can have multiple components mounted in various locations on the helmet system.

Figure 4:
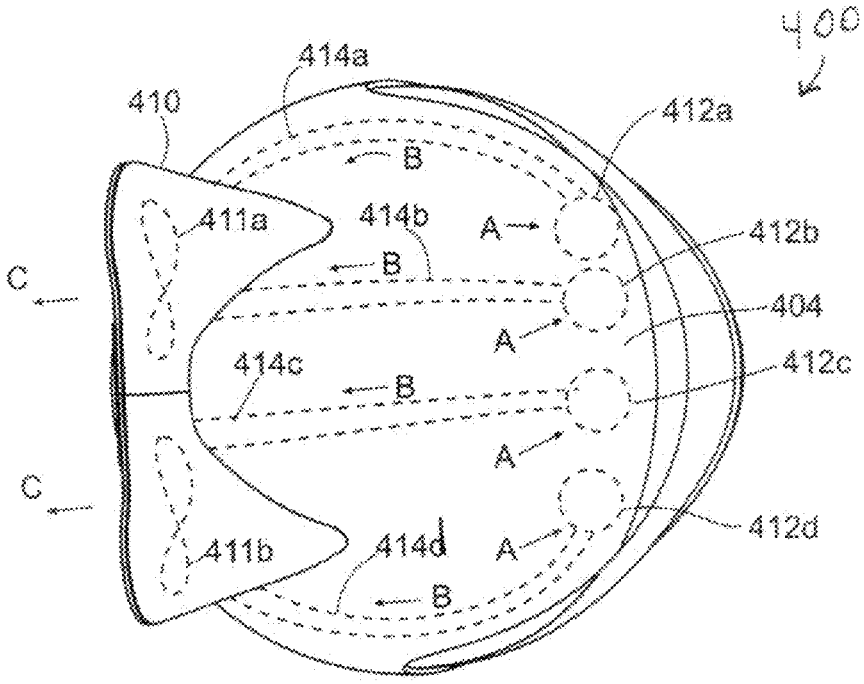
FIG. 4 provides a top view of aspects of a helmet system according to embodiments of the present invention.

FIG. 4 shows a top view of an exemplary helmet system 400 according to embodiments of the present invention. Helmet system 400 includes a ventilation system 410 in operative association with one or more suction vents 412*a*, 412*b*, 412*c*, 412*d*, via one or more passages 414*a*, 414*b*, 414*c*, 414*d*. As shown here, helmet system 400 can be configured to present passages along the top of the helmet system outer shell 404 as indicated by passages 414*b* and 414*c*, as well as along the side of the helmet system outer shell 404 as indicated by passages 414*a* and 414*d*. When fan blades 411*a*, 411*b* of ventilation system 410 are activated, air from inside of the helmet is drawn into vents 412*a*, 412*b*, 412*c*, 412*d*, as indicated by arrows A, through passages 414*a*, 414*b*, 414*c*, 414*d*, respectively, as indicated by arrows B, and is then expelled out of the ventilation system as indicated by arrows C. In some cases, a helmet system may have passages located toward the side of the helmet, such as passages 414*b* and 414*c*, and no passages toward the top or crown area of the helmet.

Hence, a fan 411*a*, 411*b* or other ventilation system component can be coupled with or in operative association with passages such as channels or tubing of the helmet system, so as to provide fluid communication between ventilation system components and the suction vents. In this way, a fan blade can draw air out of the helmet when the fan blade is activated. In some embodiments, a fan blade can operate to push air into the helmet interior. The ventilation system 410 may include a battery, a solar panel(s), a circuit card(s), a temperature sensor (s), a humidity sensor(s), or the like, according to embodiments of the present invention. Such sensors may optionally be routed at least partially within a passage such as passage 414*a*, 414*b*, 414*c*, or 414*d*.

Figure 5:
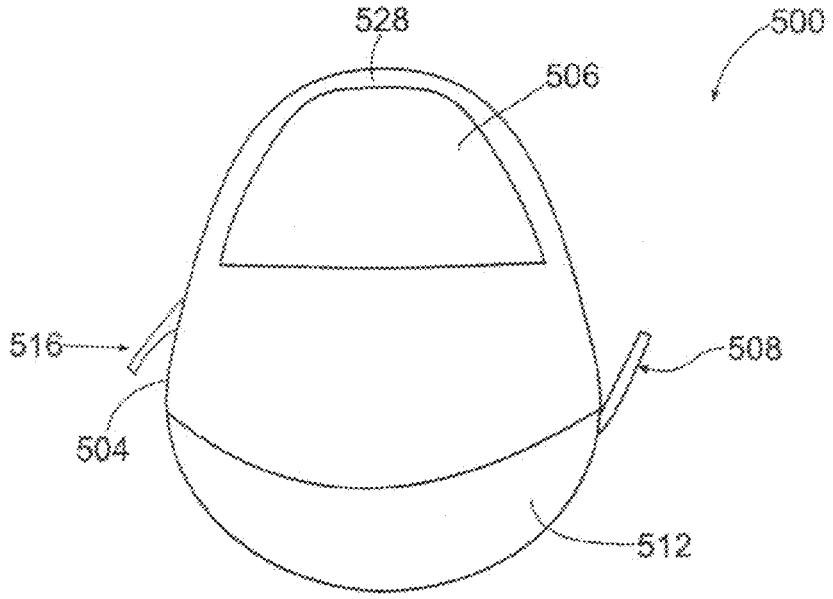
FIG. 5 presents a bottom view of aspects of a helmet system according to embodiments of the present invention.

Referring next to FIG. 5, a bottom view of an actively ventilated helmet system 500 according to embodiments of the present invention is shown. Helmet system 500 may include any of a variety of sealing mechanisms, such as a chin skirt, a neck gasket, a gaiter, or the like, which in some cases can operate to reduce heat loss from the helmet interior and prevent ingress of snow and moisture into the helmet. For example, when skiing on a powder day, a chin skirt 506 can prevent or inhibit an unwanted spray of snow beneath the visor which may otherwise occur if the chin skirt were not present. According to some embodiments, chin skirt 506 can be loosened by releasing a draw string or strap 516. When chin skirt 506 is loosened, the helmet system user can easily put on or take off the helmet system 500. In some embodiments, helmet system 500 may include a zipper or Velcro seam proximate to the outer shell 504, whereby chin skirt 506 may be coupled with the outer shell 504 or chin bar 528 of the helmet system via the zipper or seam. By unzipping the zipper or dissociating the seam, it is possible for the user to remove the chin skirt from the helmet system.

Helmet system 500 may also include a neck gasket 512 that can be tightened with a draw string or strap 508. Optionally, neck gasket 512 can be removable, via a zipper, seam, or other coupling mechanism, similar to the removable chin skirt described above. In some cases, helmet system 500 can include fit pads associated with the chin skirt, neck gasket, or both. Such fit pads may be configured to be removable. For example, it is possible for a user to remove the fit pads if they were not desired. In addition to or as an alternative to the chin skirt 506, neck gasket 512, or both, in some cases a helmet system may include a gaiter (not shown) that includes a cylindrical or conical shaped piece of fabric attached at one open end to the bottom of the helmet shell 504 or chin bar 528. In some cases, a gaiter can be tucked into the apparel worn by the helmet system user, so as to provide a snow, water, or dirt barrier that prevents or inhibits ingress of unwanted substances into the helmet interior.

Bluetooth headphones and a microphone can also be integrated inside the helmet system 500 in some embodiments. A wireless link to the wearer's wireless phone, music player, or other data storage or transmission device can allow the user to listen to music, talk on the phone, or otherwise receive or enjoy other forms of data, information, or media via the helmet system. In some embodiments, a helmet system may provide or allow for a wired link to a wireless phone, music player, or other data storage or transmission device. Noise cancelling can be used in the headphones and microphone to remove ambient noise from the surroundings, as well as noise generated by the activation or operation of the fan. Indeed, the fan movement can be coupled to the noise reduction circuitry to allow more accurate removal of that noise in some embodiments.

Figure 6:
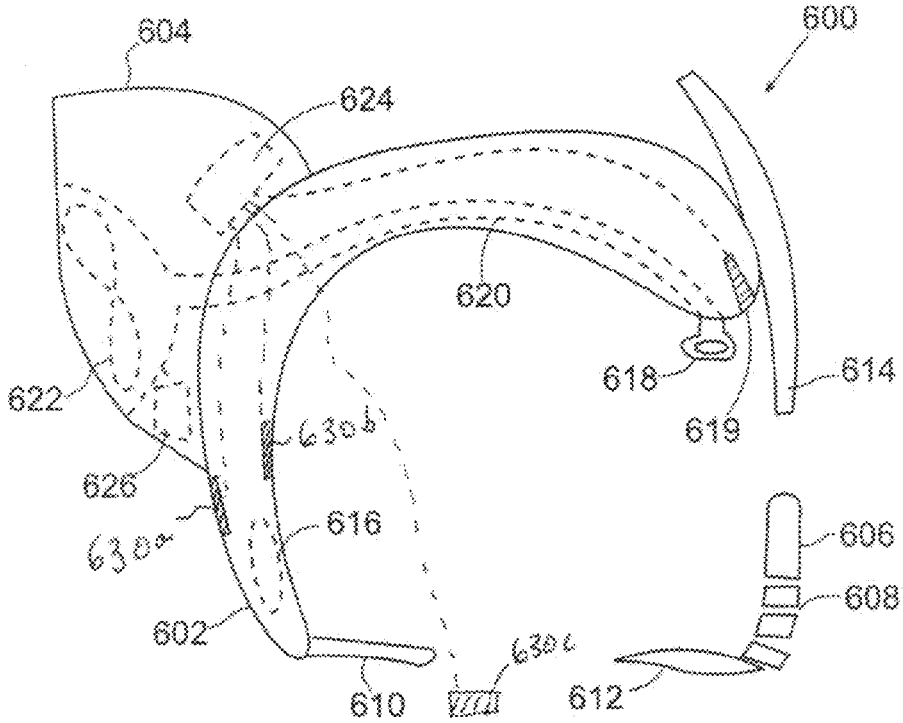
FIG. 6 shows a side cut-away view of aspects of a helmet system according to embodiments of the present invention.

With reference to FIG. 6, a cross-sectional view of an embodiment of an actively ventilated helmet 600 is shown. Helmet system 600 includes an outer shell 602, a ventilation system or module 604, a chin bar 606 having vents 608, a neck gasket 610, a chin skirt 612, a visor or face shield 614, one or more fit pads 616, one or more suction vents 618, a sensor 619 configured to sense parameters such as humidity, temperature, and the like, and one or more tubes or passages 620 disposed between ventilation system 604 and suction vents 618. According to some embodiments, ventilation system 604 may include a fan 622, a circuit card 624, and a battery or power source 626. The circuit card 624 can have a processor and drivers for one or more sensors, such as humidity sensor 619. One or more supplemental sensors 630*a*, 630*b*, 630*c*, which may include a GPS, heart rate sensor, a temperature sensor, an accelerometer, or the like, can be integrated into or in communicative association with circuit card or processor 624 in various embodiments. Hence, for example, the helmet system can be configured so that operation of the ventilation system depends, at least in part, on motion or velocity signals, or user physiological parameters. Some embodiments may include an emergency alert system that can automatically notify emergency personnel in the event of a crash or when vital signs of the helmet system user are abnormal. According to some embodiments, circuit card 624 can include a processor having an input configured to receive a signal from a humidity sensor, a module configured to determine an instruction for the air movement assembly based on the signal received from the humidity sensor, and an output configured to transmit the instruction to the ventilation system or air movement assembly. Activation of the ventilation system or air movement assembly 604 based on the instruction can operate to remove condensation from the user's field of vision by withdrawing a volume of air from the internal cavity of the helmet shell through a venting tube and expelling the volume of air out of a venting outflow aperture of the ventilation system.

As shown in FIG. 6, tube 620 can provide fluid communication between ventilation system 604 and suction vent 618. Fit pads 616 can be configured in various thicknesses to allow proper fit and padding for various head sizes. Face shield 614 is shown in the turned-up position to expose a face of the wearer. Various sizes of fit pads 616, neck gasket 610, and chin skirt 612 can be interchanged or selected according to the fit preferences of the wearer.

Figure 7:
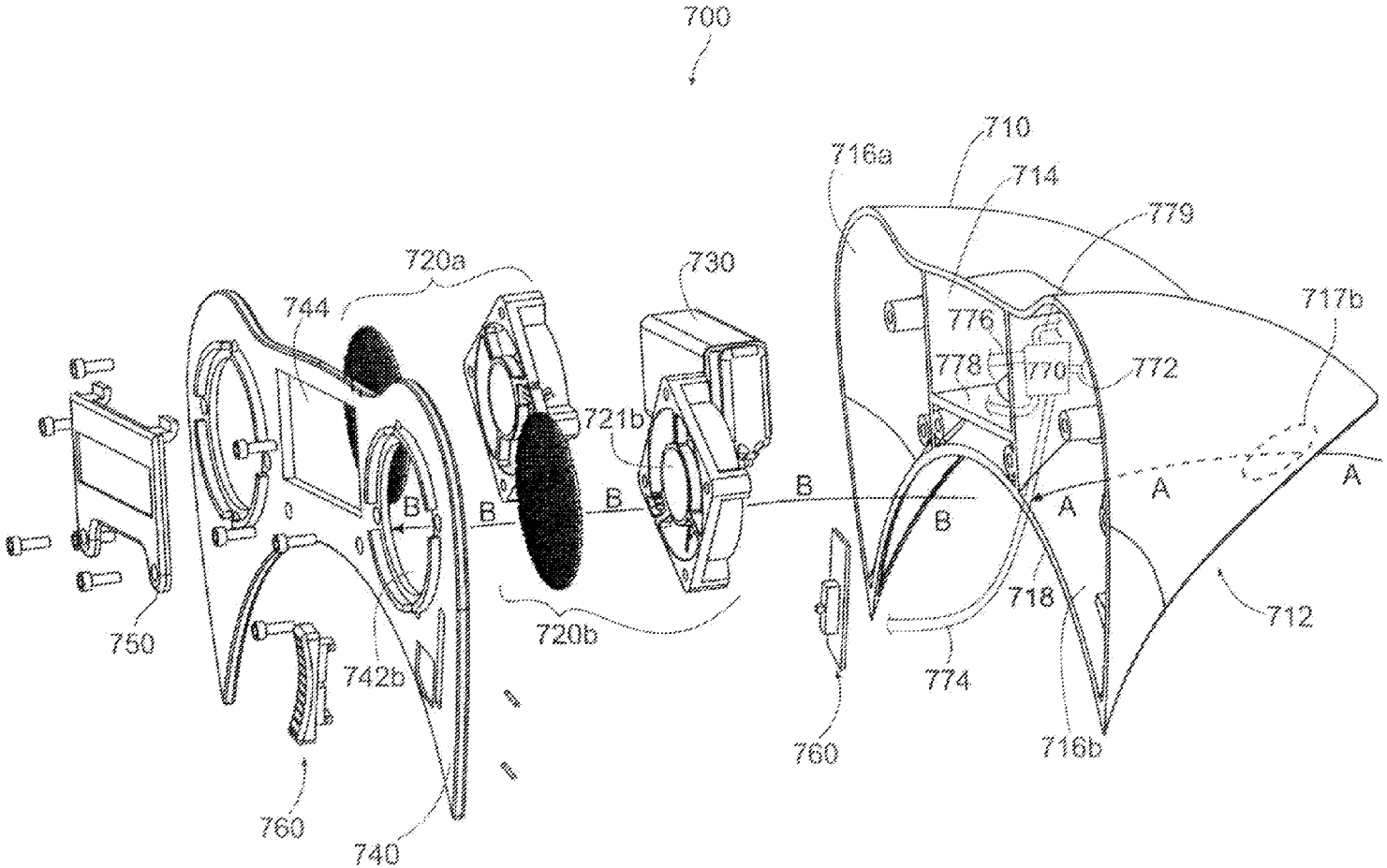
FIG. 7 illustrates an exploded view of aspects of a ventilation system according to embodiments of the present invention.

FIG. 7 illustrates aspects of a ventilation system 700 according to embodiments of the present invention. Ventilation system 700 includes a base 710, one or more air movement assemblies 720*a*, 720*b*, a power source 730 such as a battery, a chin cover 740, a power source cover 750, a power switch assembly 760, and a computer or processor 770. Base 710 includes a proximal surface or edge 712 that can be coupled with or integrated into the outer shell of a helmet system. Base 710 also includes a power source compartment 714 configured to receive or house power source 730, one or more flow channels 716*a*, 716*b*, and a distal surface or edge 718 configured to interface or couple with base cover 740. Base 710 also includes one or more flow ports 717*b*. As shown here, flow channels 716*a*, 716*b*, are configured to receive or house, or otherwise fluidly communicate with air movement assemblies 720*a*, 720*b*, respectively. In use, for example upon activation of a fan blade 721*b* of air movement assembly 720*b*, air is drawn from the interior of a helmet, through a helmet tube or passage, and into flow channel 716*b* via flow port 717*b* as indicated by arrow A. Air then flows from flow channel 716*b* through air movement assembly 720*b* toward a flow aperture 742*b* of base cover 740, as it is first drawn and then propelled by fan blade 721*b* of air movement assembly 720*b*, as indicated by arrow B. Power source 730 can include a battery, such as an N, A123, AA, AAA, AAAA or other battery configuration.

Attached with or otherwise in operative association with processor 770 is a first input 772 for receiving data, signals, or other information from one or more sensors, a second input 774 for receiving data, signals, or other information from power switch assembly 760, a third input 776 for receiving power from power source 730, a first output 778 for sending or transmitting data, signals, or other information to one or more air movement assemblies 720*a*, 720*b*, and a second output 779 for sending or transmitting data, signals, or other information to an information presentation device, such as an earphone or a heads-up display. In use, an operator can install, remove, or replace a power source 730 by accessing the power source via a power source window 744 of base cover 740. To do so, the operator may remove or disengage power source cover 750 from base cover 740, for example.

First input 772 can be configured to receive data, signals, or other information from sensors such as temperature sensors, humidity sensors, pressure sensors, accelerometers, and the like. In some cases, first input 772 can be configured to receive information from a sensor that detect the position or orientation of a helmet visor. For example, the helmet system may include a sensor that determines whether a helmet visor is open, closed, or the extent to which a visor is partially open or closed. Such visor positions can have an effect on the temperature and humidity conditions of the helmet interior. An exemplary humidity sensor can be used for reading the humidity level of the air located in the helmet interior void.

In some cases, processor 770 can be configured to control operation of the air movement assembly based on one or more physical parameters that are sensed within, outside, or as part of the helmet. For example, processor 770 can be configured to control operation of an air movement assembly based on humidity data sensed by a humidity sensor within the helmet interior. In some cases, processor 770 can be configured to control operation of the air movement assembly based on one or more physical parameters within, outside, or part of the helmet that are calculated by the processor or other computer device. For example, processor 770 can be configured to control operation of the air movement assembly based on a helmet interior humidity value that is calculated by the processor according to an algorithm. In some instances the processor can be configured to estimate or determine a helmet interior humidity value based on other factors such as helmet interior temperature, outside temperature, outside humidity, outside pressure, or any other factor that may influence the helmet interior humidity level.

According to some embodiments, processor 770 can include an input configured to receive a signal from a humidity sensor, a module configured to determine an instruction for an air movement assembly 720*a*, 720*b* based on the signal received from the humidity sensor, and an output configured to transmit the instruction to the ventilation system or air movement assembly 720*a*, 720*b*. Activation of the ventilation system or air movement assembly based on the instruction can operate to remove condensation from the user's field of vision by withdrawing a volume of air from an internal cavity of the helmet shell through a venting tube and expelling the volume of air out of a venting outflow aperture 742*b* of the ventilation system.

Figure 8:
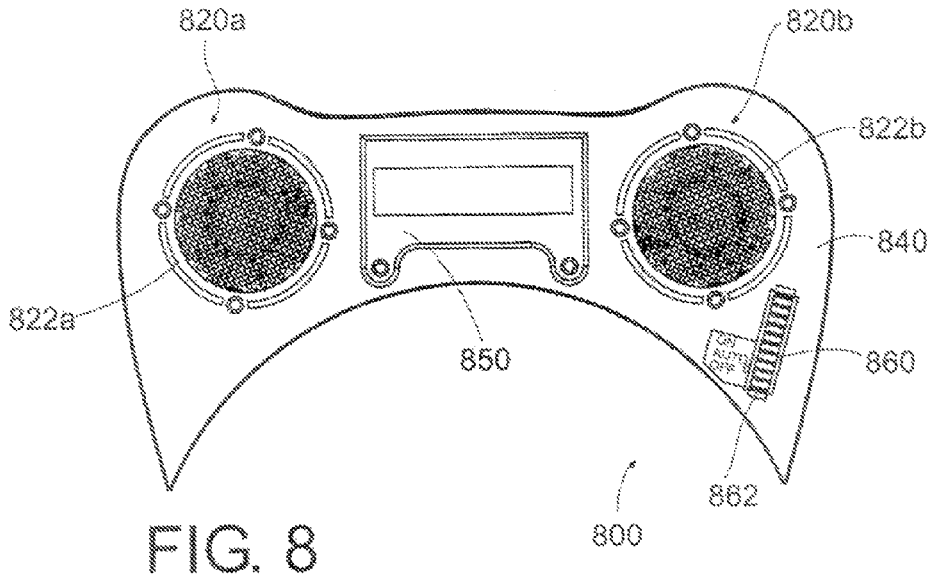
FIG. 8 depicts a rear view of aspects of a ventilation system according to embodiments of the present invention.

FIG. 8 provides a rear view of a ventilation system 800 according to embodiments of the present invention. Ventilation system 800 includes a base cover 840, a power source cover 850 coupled with or in operative association with base cover 840, a power switch assembly 860, and one or more air movement assemblies 820*a*, 820*b*. As shown here, air movement assemblies 820*a*, 820*b* include mesh screens 822*a*, 822*b*, respectively. Power switch assembly 860 includes a user switch 862 that can be moved by the user into various positions. For example, as shown here, user switch 862 can be moved into an ON position (e.g. green indicator), an AUTO position (e.g. yellow indicator), or an OFF position (e.g. red indicator). A helmet system user can control operation of the air movement assemblies by placing the user switch at the desired setting.

In some cases, the helmet system can be configured to produce continuous operation of an air movement assembly when user switch 862 is in the ON position. Relatedly, a helmet system can be configured to provide air movement assembly operation only when activated by a signal from a humidity sensor, when user switch 862 is in the AUTO position. A helmet system can be configured to deactivate or prevent operation of an air movement assembly or humidity sensor when user switch is in the OFF position. When user switch 862 is set to OFF, the helmet system can be configured to present no draw on the battery or power source.

In the OFF position, power is not being drained from the battery or power source and the ventilation system can be considered dormant or passive. In the ON position, the automatic operation of the ventilation system is overridden and the fan assembly or air movement assembly is operated full-time until the switch is repositioned. In the AUTO position, the full benefit of the humidity sensor is utilized and the system works in its optimal manner providing unobstructed vision in a variety of conditions.

Figure 9:
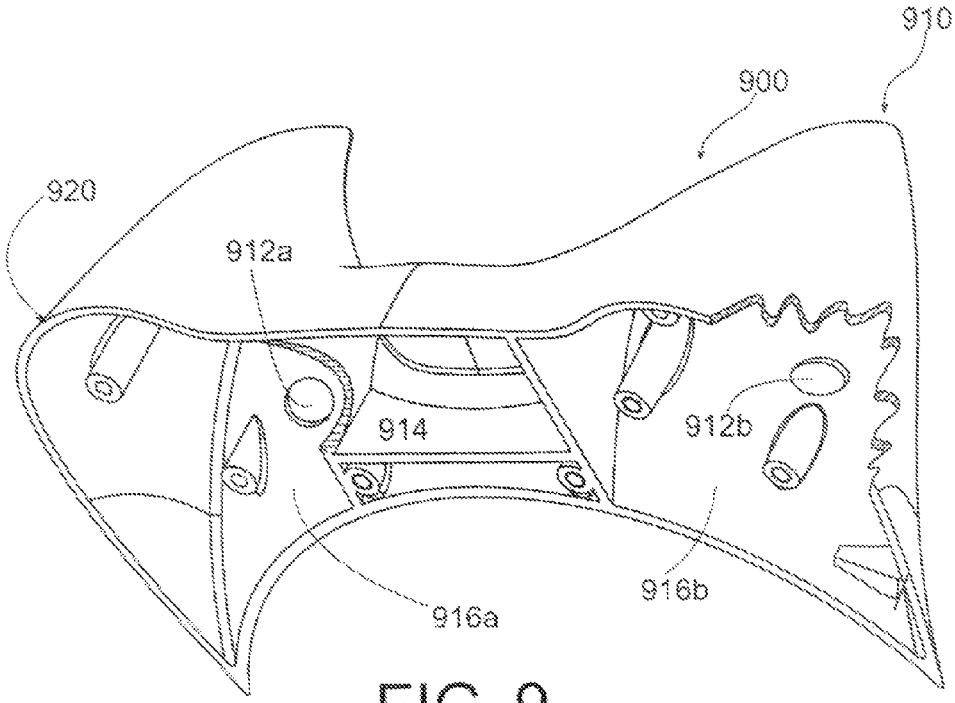
FIG. 9 shows a perspective view of aspects of a ventilation system base according to embodiments of the present invention.

FIG. 9 illustrates aspects of an exemplary ventilation system base 900 according to embodiments of the present invention. As shown here, base 900 includes a proximal portion 910 having one or more flow ports 912*a*, 912*b* configured to receive air from a tube or passage of a helmet system. Base 900 also includes a distal portion 920 that is contoured or otherwise configured to interface or couple with a base cover. Base 900 also includes a power source compartment 914 configured to receive or house a power source, and one or more flow channels 916*a*, 916*b*.

It is understood that a helmet system or method according to embodiments of the present invention can incorporate one or more elements or features of the goggle systems and methods disclosed in previously incorporated U.S. patent application Ser. No. 12/534,597, filed on Aug. 3, 2009, and U.S. Provisional Patent Application No. 61/085,784, filed on Aug. 1, 2008, both entitled "Ventilation System for Goggles."

According to some embodiments, helmet systems are configured to perform condensation control and other functions while producing no annoying vibrations. Any of a variety of power sources may be used to provide power to the helmet system operation, including for example solar power, battery power, or a combination thereof. In some cases, the helmet system can be configured to operate on AA or AAA batteries. A user switch of the helmet system can be configured with a surface that can easily be maneuvered by a user wearing a ski glove. Relatedly, a helmet system can be configured so that a user can easily rotate a visor up or down, while wearing ski gloves. In some cases, a helmet system includes an optional skirt across the bottom front of the helmet to keep snow from entering the face area from below. Relatedly, in some cases a helmet system includes an optional or removable neck gaiter that attaches to the bottom of the helmet and extends into the wearers chest area. In some cases, a helmet system can incorporate aerodynamic elements built into or as part of the outer shell that, when the wearer is moving at speed, create low pressure areas that facilitate movement of air from the face area to the atmosphere. Helmet systems may include a neck skirt that can be activated by either sliding a skirt lever from a forward position to a rearward position or by pulling on a tensioning strap. According to some embodiments, an accessory neck gaiter can be deployed by attaching it to the bottom edge of the helmet. Individual helmet system components, for example foam fit pads or lenses, can be removable for cleaning or replacement. In some cases, a chin guard can be removable so as to facilitate access to helmet internals, increase airflow as desired, or to tailor protection as desired.

Embodiments of the present invention encompass helmet systems having a removable skirt coupled with a bottom edge of the helmet. In some cases, a helmet system may include a visor that is pivoting, removable, or both. Optionally, a helmet system may include a photochromatic visor, a cooling system, stereophonic headphones, Bluetooth capability, a pop-up bi-focal feature, a heads-up display, or any combination thereof. According to some embodiments, a helmet system can be configured to provide a heads-up display that presents GPS data, location data, altitude data, compass data, speed or velocity data, and sport activity such as the vertical distance skied or traveled in one day, the vertical distance skied or traveled in total, the number of runs skied, and the like. A helmet system can also be configured to provide a heads-up display that presents health information, such as heart rate information, maximum heart rate information, high-low alarms, and the like. Further, a helmet system can be configured to provide a heads-up display that presents environmental information such as temperature, humidity, barometric pressure, time, and the like.

Embodiments of the present invention encompass helmet systems and methods that protect a user from snow, wind, glare, extreme cold, frostbite, sunburn, and UV radiation, while providing optimal and increased peripheral vision in a fog free environment. Additionally, embodiments can provide impact protection to the head and face of the wearer. Embodiments can also provide a heads-up display in a helmet system having an integrated helmet shell and visor configuration, that includes an air movement assembly or fan module that is capable of fully automated operation. Full coverage helmets may incorporate a bar extending across the front of the helmet and to each side of the helmet. A helmet system can include a visor that slides down from the top of the helmet and engages the helmet at the front bar, thus providing complete coverage from the elements. A visor can be removable and interchangeable. A skirt around the bottom edge of the helmet can provide an additional seal against the elements. Heads up technology incorporated into a helmet system can allow the user to read or view real time data transmissions directly in his field of vision. For example, a user may view features of a ski area GPS map on the eyeshield. Helmet systems may also include audio components such as stereophonic headphones, Bluetooth components, and microphones, that can be for example incorporated into the ear cavities and chin bar enabling the user to hear music, and make or receive phone calls. Helmet systems and methods of the present invention are well suited for use by individuals engaging in skiing, motorsports, powersports (including special iterations), military activities, and tactical occupations such as those involved with police and fire departments.

Helmet system embodiments also provide light weight helmets which can be used in sports where equipment weight issues can pose a detrimental effect on performance. For example, in the sport of skiing, the skier's body is continually moving left and right, up and down, and pitching forward and backward. An excessively heavy helmet can cause unwanted stress and strain on a skier's body. Further, an air movement assembly or fan unit that is activated by a humidity sensor can effectively control fogging within the helmet interior. In some cases, a helmet system can provide optimized vision or optical characteristics by integrating the eyewear into the helmet shell, so as to create a larger volume of air inside the helmet, whereby the air movement assembly or fan unit can vent any fog-creating moisture contained in the helmet outward to the ambient atmosphere. Such embodiments are well suited for use with traditional helmet or goggle wearers who wear eyeglasses, because the spacious interior of the instant helmet systems provide the user with ample interior helmet space that easily accommodates the user's eyeglasses. In some cases, helmet system embodiments can provide a user with a de-centered, optically correct, single molded lens that delivers an un-distorted, fog free view.

Helmet systems and methods may be provided in one or more kits for such use. The kits may comprise one or more helmet systems as described herein, and instructions for use. Optionally, such kits may further include any of the other system components described in relation to embodiments of the present invention and any other materials or items relevant to embodiments of the present invention. The instructions for use can set forth any aspect of the methods as described above.

Each of the methods, processes, calculations, or operations described herein may be performed using a computer or other processor or module having hardware, software, and/or firmware. In some cases, various method steps may be performed by computers, processors, or modules, and the computers, processors, or modules may comprise any of a wide variety of digital and/or analog data processing hardware and/or software arranged to perform the method steps described herein. The computers, processors, or modules optionally may include data processing hardware adapted to perform one or more of these steps by having appropriate machine programming code associated therewith, the computers, processors, or modules for two or more steps (or portions of two or more steps) being integrated into a single processor board or separated into different processor boards in any of a wide variety of integrated and/or distributed processing architectures. These methods and systems will often employ a tangible media embodying machine-readable code, which may be part of a computer, processor, or module, with instructions for performing the method steps described herein. Suitable tangible media may comprise a memory (including a volatile memory and/or a non-volatile memory), a storage media (such as a magnetic recording on a floppy disk, a hard disk, a tape, or the like; on an optical memory such as a CD, a CD-R/W, a CD-ROM, a DVD, or the like; or any other digital or analog storage media), or the like.

While the principles of the disclosure have been described above in connection with specific apparatuses and methods, it is to be clearly understood that this description is made only by way of example and not as limitation on the scope of the disclosure. By way of example and for clarity of understanding, those of skill in the art will recognize that a variety of modification, adaptations, and changes may be employed.

What is claimed is:

1. A helmet system for removing condensation from a user's field of vision, comprising:

a helmet shell having an anterior section, a posterior section, and a venting passage, wherein the helmet shell defines an internal cavity that is in fluid communication with a front portion of the venting passage, and wherein the internal cavity is configured to receive the user's head;

a visor coupled with the helmet shell, wherein at least part of the visor defines part of the internal cavity;

a humidity sensor positioned within the internal cavity of the helmet shell; and a ventilation system comprising:

a base coupled with the helmet shell, wherein the base has a first venting aperture in fluid communication with a rear portion of the venting passage, a base cover coupled with the base, wherein the base cover has a second venting aperture, an air movement assembly disposed between the base and the base cover, wherein the air movement assembly provides fluid communication between the first venting aperture and the second venting aperture, a switch, a power source, and a circuit card comprising:

a first input configured to receive a signal from the humidity sensor, a second input configured to receive a second signal from the switch, a first module configured to determine a first instruction for the air movement assembly based on the signal received from the humidity sensor, a second module configured to determine a second instruction for the air movement assembly based on the second signal received from the switch, a first output configured to transmit the first instruction to the air movement assembly, wherein activation of the air movement assembly based on the first instruction operates to remove condensation from the user's field of vision by moving a volume of air of the internal cavity of the helmet shell through the venting passage and moving the volume of air through the second venting aperture of the base cover between the anterior section and the posterior section, and a second output configured to transmit the second instruction to the air movement assembly, wherein the second instruction controls whether power is delivered to the air movement assembly and controls whether the air movement assembly directs air flow from the first venting aperture toward the second venting aperture or from the second venting aperture toward the first venting aperture.

2. The helmet system according to claim 1, wherein the air movement assembly comprises one or more rotary fans.

3. The helmet system according to claim 1, further comprising an exterior space sensor, wherein the circuit card has a third input configured to receive a third signal from the exterior space sensor, and the circuit card is configured to determine the instruction for the air movement assembly based on the third signal received from the exterior space sensor.

4. The helmet system according to claim 3, wherein the exterior space sensor comprises a temperature sensor.

5. The helmet system according to claim 1, further comprising a supplemental sensor, wherein the circuit card has a third input configured to receive a third signal from a supplemental sensor, and the circuit card is configured to determine the instruction for the air movement assembly based on the third signal received from the supplemental sensor.

6. The helmet system according to claim 1, further comprising a supplemental sensor, wherein the supplemental sensor comprises a member selected from the group consisting of an accelerometer, a global positioning satellite sensor, a heart rate sensor, a temperature sensor, and a humidity sensor.

7. The helmet system according to claim 1, wherein the helmet shell comprises a chin bar having a vent.

8. A helmet system for removing condensation from a user's field of vision, comprising:

a helmet shell having:

an anterior section having an interior surface and an exterior surface, and a posterior section, having an exterior surface an internal cavity, configured to receive the user's head;

a visor coupled with the anterior section of the helmet shell, wherein the visor in an engaged position further defines the internal cavity;

a sensor, which measures humidity within the internal cavity;

a first venting aperture positioned on the exterior surface of the posterior section in fluid communication with a second venting aperture positioned on the interior surface of the anterior section via a first venting passage;

a first assembly comprising:

an air movement assembly configured to bias fluid communication between the first venting aperture and the second venting aperture;

an input configured to receive a signal from the sensor;

a module configured to determine an instruction for the air movement assembly based on the signal received from the humidity sensor; and an output configured to transmit the instruction to the air movement assembly, wherein activation of the air movement assembly based on the instruction operates to remove condensation from the user's field of vision by moving a volume of air of the internal cavity of the helmet shell through the first venting passage;

a second assembly comprising:

an external passive intake aperture positioned at the exterior surface of the anterior section;

a passive output aperture positioned at the exterior surface of the posterior section and in fluid communication with the external passive intake aperture via a first passive venting passage; and an internal passive intake aperture positioned at the interior surface of the anterior section in fluid communication with the first passive venting passage via a second passive venting passage, wherein the external passive intake aperture is configured to permit air to flow into the first passive venting passage to create a low pressure environment within the first venting passage that draws air out of the internal cavity through the interior passive intake aperture and out through the passive output aperture.

9. The helmet system according to claim 8, further comprising an exterior space sensor, which produces a second signal used by the module to determine the instruction.

10. A helmet module for removing condensation from a user's field of vision in a helmet includes a visor, comprising:

a humidity sensor input configured to couple to a humidity sensor signal detecting humidity of an internal cavity defined by a helmet shell and the visor;

a base configured to be coupled with the helmet, wherein the base has a first venting aperture configured for fluid communication with a venting passage of the helmet;

a base cover coupled with the base, wherein the base cover has a second venting aperture;

an air movement assembly disposed between the base and the base cover, wherein the air movement assembly biases fluid communication between the first venting aperture and the second venting aperture, a power source;

a switch configured to transmit a switch signal;

a first module configured to determine a first instruction for the air movement assembly based on the switch signal;

a second module configured to determine a second instruction for the air movement assembly based on the humidity sensor signal;

a first output configured to transmit the first instruction to the air movement assembly, wherein the first instruction controls whether power is delivered to the air movement assembly and controls whether the air movement assembly directs air flow from the first venting aperture toward the second venting aperture or from the second venting aperture toward the first venting aperture; and a second output configured to transmit the second instruction to the air movement assembly, wherein activation of the air movement assembly based on the instruction operates to remove humidity from the user's field of vision by moving a volume of air between:

the internal cavity using the first venting aperture, and the second venting aperture of the base cover.

11. The helmet module according to claim 10, wherein the air movement assembly comprises one or more rotary fans.

12. The helmet module according to claim 10, wherein the base cover is integral with the helmet shell.

13. The helmet module according to claim 10, wherein the power source is coupled to external power, which is separate from the helmet module.

14. The helmet system according to claim 1, wherein at least one of the base cover and the base are integral with the helmet shell.

15. The helmet system according to claim 1, wherein the power source is coupled to a port, which is coupled to external power, which is separate from the helmet system.

16. The helmet system according to claim 1, wherein the base is coupled with the posterior section.

17. The helmet system according to claim 1, wherein the visor is coupled with the anterior section.

18. The helmet system according to claim 1, wherein the air movement assembly pulls air from the front portion of the venting passage.

19. The helmet system according to claim 1, wherein the air movement assembly pushes air toward the front portion of the venting passage.

20. The helmet system according to claim 1, wherein the venting passage is routed away from a crown area of the helmet shell.

21. The helmet system according to claim 1, further comprising a passive venting passage providing fluid communication between the internal cavity and an outside of the helmet system.

22. The helmet system according to claim 1, wherein:

the air movement assembly includes a fan axis of rotation, and the fan axis points toward the internal cavity of the helmet shell.

* * * * *